United States Patent [19]

Reinders

[11] 4,014,027

[45] Mar. 22, 1977

[54] OMNIDIRECTIONAL ANTENNA FOR AROUND A MAST

[75] Inventor: Michiël Antonius Reinders, Zoetermeer, Netherlands

[73] Assignee: De Staat der Nederlanden, te Dezen Vertegenwoordigd Door de Directeur-Generaal der Posterijen, Telegrafie en Telefonie, The Hague, Netherlands

[22] Filed: Jan. 19, 1976

[21] Appl. No.: 650,306

[30] Foreign Application Priority Data

Jan. 21, 1975 Netherlands ..... 7500682

[52] U.S. Cl. ..... 343/779; 343/781 P; 343/891

[51] Int. Cl.[2] ..... H01Q 19/14

[58] Field of Search ..... 343/781, 781 P, 837, 343/840, 891, 912, 779

[56] References Cited

UNITED STATES PATENTS

| | | | |
|---|---|---|---|
| 2,549,143 | 4/1951 | Tinus | 343/912 |
| 2,881,431 | 4/1959 | Hennessey | 343/781 |
| 3,317,912 | 5/1967 | Kelleher | 343/840 |

*Primary Examiner*—Eli Lieberman
*Attorney, Agent, or Firm*—Hugh A. Kirk

[57] ABSTRACT

Omnidirectional antenna provided with a rotation-symmetrical reflector and a concentric radiator, to be mounted around a mast, which radiator has an uninterrupted annular exit edge. All the diametrical cross sections of the radiator along the axis of the antenna are uniform. The path followed by the radiation in the radiator beyond the part deflecting from the axis of the antenna, is turned up in the direction of the reflector.

3 Claims, 3 Drawing Figures

OMNIDIRECTIONAL ANTENNA FOR AROUND A MAST

BACKGROUND OF THE INVENTION

Known is an omnidirectional antenna mounted around a mast and having a reflector consisting of a number of panels, which are each provided with a radiator. The panels are grouped in a regular polygon around a mast, so that they fully enclose it. A drawback of this antenna is that the radiation diagram is not rotation-symmetrical. Problems particularly arise in the areas in which the radiation of one panel joins that of the next panel. In order to attain a desired field strength in those areas, the edge of the panel is irradiated at a lower level than its middle part. The consequence will be that part of the energy supplied by the radiator will be radiated beside the panel and will be lost.

According to another known construction for an omnidirectional antenna on a mast-head, the radiator has the shape of a round or cylindrical box, which is fed from the centre. The box wall inside the turned-up exit edge can be fixed in the middle to the tip of the reflector or to the enclosing box wall. However, when making use of such embodiments inadmissable distortions may easily occur. The box wall inside the radiator opening is preferably fixed to a material, e.g. synthetic material, that covers this radiator opening. The distorting influence of the synthetic ring on the radiation diagram of the radiator is negligible because the ring is narrow.

For an antenna mounted on a mast-head the radiator can be fed from the centre by means of a coaxial connection or a wave guide with a round cross-section. When, according to the invention, an antenna is to be placed around a mast, several methods of feeding the radiator can be thought of, but it is difficult to find an ideal construction.

SUMMARY OF THE INVENTION

The object of the invention is to solve the problems attending the use of the aforesaid antennae, which object has been attained because the radiator has an uninterrupted annular exit edge and because all the diametrical cross-sections of the radiator along the axis of the antenna are uniform. The path followed by the radiation in such a radiator, beyond the part deflecting from the axis of the antenna, is turned up in the direction of the reflector. When using such a radiator one reflector will suffice.

The invention offers a construction in which the radiator is formed by the edge of a round box, the central part of which is turned down along a number of lines forming a regular polygon in as many triangular sectors, each sector being provided with a feeding point and the reflector being truncated. Owing to the truncated reflector and the turned-down sectors there is a central opening for a mast.

BRIEF DESCRIPTION OF THE VIEWS

The above mentioned and other features, objects and advantages, and a manner of attaining them are described more specifically below by reference to an embodiment of this invention shown in the accompanying drawing, wherein.

DETAILED DESCRIPTION OF PRIOR ART

Figure 1:
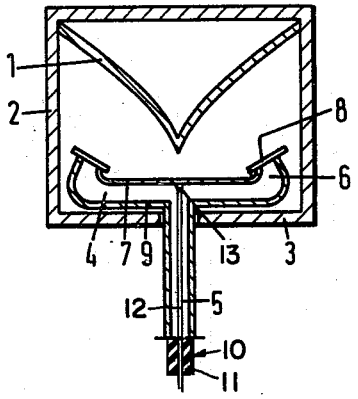
FIG. 1 PRIOR ART
FIG. 1 is a cross-section of a prior art antenna to be mounted on a mast-head.

The known omnidirectional antenna according to FIG. 1 has a simple rotation-symmetrical reflector 1, supported by a cylindrical wall 2, which transmits radiation and which rests on the bottom or base disc 3. On this bottom 3 there is a radiator 4, having the shape of a round box, which can be fed from the centre by means of a coaxial wave guide 5. The radiator 4 has a turned-up peripheral exit edge 6. The top box wall 7 inside the edge 6 is fixed to a frusto-conical ring 8, which covers the edge 6. This ring 8 may be made of synthetic material. The top and bottom walls 7 and 9 of the radiator 4 consist of rotation-symmetrical discs or plates, which are placed exactly parallel to one another.

The feeding wave guide 5 is utilized for transmitting horizontally polarized waves; the wave guide being excited in the TEo1 (transverse electric) mode. The feeding takes place by means of a coaxial cable which transports the TEM (transverse electromagnetic) fundamental mode or by means of a wave guide that is excited in the TMo1 mode, which modes are utilized when the antenna is to transmit vertically polarized waves.

The coupling of a coaxial cable 10 to the radiator can take place by connecting the outer conductor 12 to the plate 9 and by extending the inner conductor, if necessary as far as the plate 7.

The coupling of a wave guide to the radiator can take place by fixing the wave guide to the plate 9, so that the inner conductor 11 radiates in the space between the plates. If necessary, the plate 7 can be provided with a depending conical elevation 13 in order to assist the lateral deflection of the radiation.

A rotation-symmetrical wave will travel from the centre in radial directions.

In order to prevent that modes of higher order will travel between the parallel plates 7 and 9, it will be necessary to choose the distance for a vertical polarization smaller than half a wave-length and for a horizontal polarizaton smaller than a whole wave-length.

The edge of the radiator 4 is turned up and can be widened a little in the shape of a horn, so that a certain concentration of energy is obtained in the vertical plane and the energy density of the radiation striking the reflector 1, mounted over it, is about 10 dB larger in the middle than at the top or at the bottom.

When a maximum antenna gain is required, the reflector 1 in the vertical plane will have the shape of a parabola or almost a parabola. In order to realize the required energy distribution in the vertical plane the reflector has to be given an adapted shape, which will generally deviate from the parabola. This known antenna will be reverted to in what follows.

DETAILED DESCRIPTION OF A PREFERRED EMBODIMENT

Figure 2:
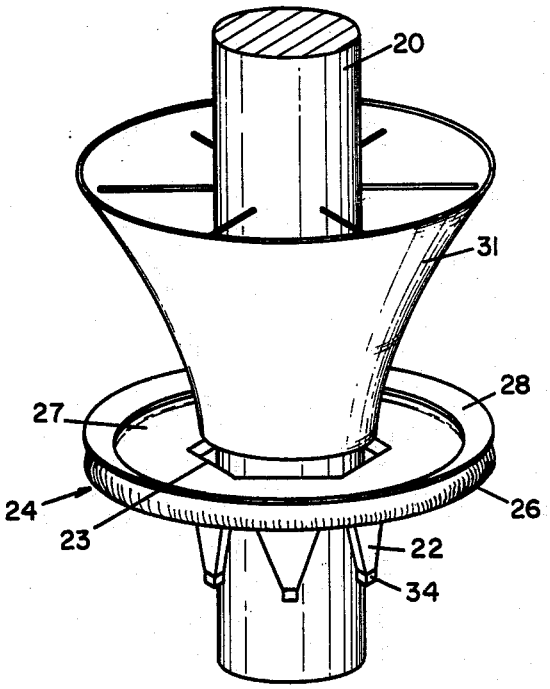
FIG. 2 is a perspective view of an antenna according to a preferred embodiment of this invention mounted around a mast.
Figure 3:
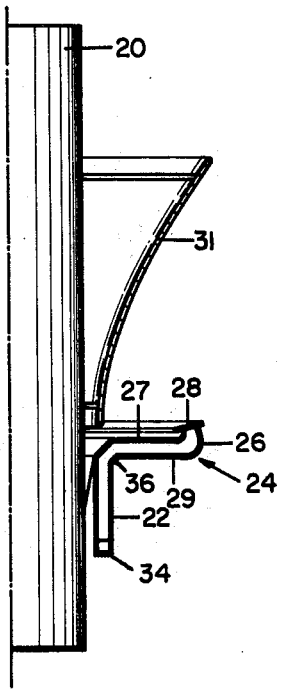
FIG. 3 is a radial vertical cross-section of the antenna shown in FIG. 2.

The antenna according to the invention and represented by the FIGS. 2 and 3 can be mounted around a mast 20. The feeding system consists of a set of flat bent horns 22, which serve to feed a rotation-symmetrical annular radiator 24 having an exit edge 26. Over the radiator 24 there is a rotation-symmetrical reflector 31, which is truncated to give room for the mast 20. The antennae according to the example in FIGS. 2 and 3 are utilized for radiating horizontally polarized energy.

As compared with the known antenna to be mounted around a mast, the antenna according to the invention, when fed in a suitable way, offers the possibility of effecting a better rotation-symmetry of the radiation diagram. Moreover, when utilizing an annular radiator 24, no energy will be radiated past the reflector 31, in consequence of which a higher efficiency will be obtained.

One of the conditions for a realization of the said characteristics is that the strength and the phase of the field in the annular radiator 24 are equal at all the points of any concentric circle. This has been attained because of the set of bent horns 22. This arrangement has been obtained by starting, so to speak, from a round or flat cylindrical or disc shaped box 24, the central part of which is pierced or pressed open in the middle to form the annular radiator 24, which pushed open central part in the present embodiment forms six triangular sectors or horns 22 that turn down axially of the mast to form the opening for the mast 20. These sectors 22 are bent along straight lines to form a regular hexagonal hole 23 in the disc shaped radiator 24.

The starting-point of each sector or flat horn 22 is provided with a feeding point 34 at its bent out apex for the connection of a wave guide or a coaxial cable. The connection has been effected such that the fundamental mode is excited and its strength is constant, i.e. that the E-vector is parallel to the widening walls and that on circular lines have the feeding point 34 for their centre. The feeding of the sectors 22 has to be such that the phase and the intensity of the energy supplied is equal in all the feeding points 34.

Thanks to the shape of the flat horns 22 it has been attained that the rays have to travel equal paths from the feeding points 34 to the exit edge 26 and to its frusto-conical ring 28, so that one of the said conditions for a correct working of the antenna has been satisfied. Moreover, the strength of the field between the parallel plates 27 and 29 for the type of mode which is excited, is constant on circular lines having the feeding points for centres, which, beyond the bends 36 in the horns 22, results in a constant field strength for closed circular lines having the central point of the exit edge 26 for their centre. As a result the other condition for a good working of the antenna has been satisfied.

It is not necessary to extend the side-walls of the horns between the parallel plates 27 and 29, but it does not encounter difficulties to do so for mechanical reasons.

While there is described above the principals of this invention in connection with specific apparatus, it is to be clearly understood that this description is made only by way of example and not as a limitation to the scope of this invention.

What we claim is:

1. An omnidirectional antenna surrounding a mast having a uniform diametrical cross-section at all angles comprising:

A. an annular truncated rotation-symmetrical reflector,

B. an annular radiator having an outer circular peripheral edge and an inner polygonal edge adjacent the mast, and C. a plurality of triangular shaped horns parallel to the axis of said mast feeding the polygonal inner edge of said radiator.

2. An antenna according to claim 1 wherein said horns are fed at their apices spaced from said radiator.

3. An antenna according to claim 1 wherein said annular radiator includes a truncated conical annular ring adjacent said circular peripheral edge directed toward said reflector.

* * * * *

UNITED STATES PATENT OFFICE

CERTIFICATE OF CORRECTION

Patent No. 4,014,027 Dated March 22, 1977

Inventor(s) Michiel Antonius Reinders

It is certified that error appears in the above-identified patent and that said Letters Patent are hereby corrected as shown below:

| | |
|---|---|
| Column 2, line 32 | after "conductor" insert - - 11 of the cable 10 - - |
| Column 2, line 33 | after "conductor" insert - - 12 - - |

Signed and Sealed this

*nineteenth* Day of *July 1977*

[SEAL]

*Attest:*

RUTH C. MASON
*Attesting Officer*

C. MARSHALL DANN
*Commissioner of Patents and Trademarks*